US007168414B2

(12) United States Patent
Harvey

(10) Patent No.: US 7,168,414 B2
(45) Date of Patent: Jan. 30, 2007

(54) MARINE VAPOR SEPARATOR WITH BYPASS LINE

(75) Inventor: Richard W. Harvey, Logansport, IN (US)

(73) Assignee: Federal Mogul World Wide, Inc., Southfield, MI (US)

( * ) Notice: Subject to any disclaimer, the term of this patent is extended or adjusted under 35 U.S.C. 154(b) by 178 days.

(21) Appl. No.: 10/933,748

(22) Filed: Sep. 3, 2004

(65) Prior Publication Data

US 2006/0048757 A1 Mar. 9, 2006

(51) Int. Cl.
*F02M 73/04* (2006.01)

(52) U.S. Cl. ..... 123/509; 123/516

(58) Field of Classification Search ..... 123/509, 123/510, 511, 514, 516
See application file for complete search history.

(56) References Cited

U.S. PATENT DOCUMENTS

| | | | | | |
|---|---|---|---|---|---|
| 5,044,344 | A | | 9/1991 | Tuckey et al. | 123/497 |
| 5,231,967 | A | * | 8/1993 | Baltz et al. | 123/497 |
| 5,309,885 | A | * | 5/1994 | Rawlings et al. | 123/509 |
| 5,313,978 | A | | 5/1994 | Takai et al. | 137/43 |
| 5,471,962 | A | | 12/1995 | Nakashima et al. | 123/456 |
| 5,577,482 | A | | 11/1996 | Nakashima et al. | 123/491 |
| 5,647,331 | A | * | 7/1997 | Swanson | 123/516 |
| 5,673,670 | A | * | 10/1997 | Powell et al. | 123/463 |
| 5,699,772 | A | | 12/1997 | Yonekawa et al. | 123/497 |
| 5,797,378 | A | * | 8/1998 | Kato | 123/516 |
| 5,927,253 | A | | 7/1999 | Oyafuso et al. | 123/456 |
| 5,964,206 | A | * | 10/1999 | White et al. | 123/541 |
| 6,012,434 | A | * | 1/2000 | Hartke et al. | 123/516 |
| 6,109,246 | A | * | 8/2000 | Takayanagi et al. | 123/516 |
| 6,257,208 | B1 | | 7/2001 | Harvey | 123/516 |
| 6,318,344 | B1 | | 11/2001 | Lucier et al. | 123/516 |
| 6,367,455 | B2 | | 4/2002 | Hirata et al. | 123/497 |
| 6,474,310 | B2 | | 11/2002 | Joos et al. | 123/497 |
| 6,526,946 | B1 | * | 3/2003 | Kanno | 123/493 |
| 6,527,603 | B1 | * | 3/2003 | Wickman et al. | 123/509 |
| 6,557,533 | B2 | * | 5/2003 | Katayama et al. | 123/516 |

(Continued)

*Primary Examiner*—Thomas Moulis
(74) *Attorney, Agent, or Firm*—Dickinson Wright PLLC

(57) ABSTRACT

In a fuel supply system, liquid fuel is supplied to a marine engine from a fuel tank (10). The fuel first passes through a water filter (14), a lift pump (18) and is temporarily deposited in a vapor separator (20) where vapors given off from the fuel are collected and vented. A high pressure pump (30) withdraws liquid fuel from the vapor separator (200 and delivers it under pressure to an engine injector system (36) via a fuel delivery line (34). The fuel pressure between the high pressure pump (30) and the engine injector system (36) is monitored to determine whether the engine injector system (36) is being presented with more fuel than is required for efficient engine operation. If more fuel than needed is being supplied by the high pressure pump (30), the unneeded fuel is returned to the vapor separator (20) through a bypass line (40). A pressure regulator (42) along the bypass line (40) prevents the return of fuel to the vapor separator (20) when the pressure differential between the vapor separator (20) and the fuel being delivered to the engine injector system (36) reaches a predetermined value. The bypass line (40) comprises a short path from the fuel delivery line (34) and returns fuel back into the vapor separator (20) without traversing large spaces. The water filter (14), lift pump (18), vapor separator (20), high pressure pump (30), by-pass line (40) and pressure regulator (42) are contained as an integral unit (46).

10 Claims, 2 Drawing Sheets

U.S. PATENT DOCUMENTS 6,622,707 B2 9/2003 Begley et al. ..... 123/497
6,647,769 B1 * 11/2003 Fujino et al. ..... 73/119 A
6,655,366 B2 * 12/2003 Sakai ..... 123/518
6,679,229 B2 * 1/2004 Wada et al. ..... 123/516
6,688,163 B2 * 2/2004 Fujino et al. ..... 73/116
6,694,955 B1 * 2/2004 Griffiths et al. ..... 123/516
6,718,953 B1 * 4/2004 Torgerud ..... 123/516

* cited by examiner

MARINE VAPOR SEPARATOR WITH BYPASS LINE

BACKGROUND OF THE INVENTION

1. Field of the Invention

The subject invention relates to a system for supplying fuel under pressure to an internal combustion engine in a marine vessel, and, more specifically, addresses the problem of controlling fuel delivery to a fuel injection system in a marine engine.

2. Description of the Prior Art

In fuel supply systems for marine engines, and in particular for so-called in-board and stern drive type engines, it is often challenging to supply an uninterrupted flow of fuel under all operating conditions. The operating environment is frequently very hot, causing the fuel to vaporize if not carefully controlled. And fuel delivery must be compatible with marine engine run cycles which are characterized by long periods of operation at a steady RPM, punctuated by abrupt instances of rapid acceleration or deceleration. Throughout these cycles and conditions, fuel is expected to be delivered to the engine without interruption.

Furthermore, marine applications are often subject to harsh vibrations and jarring. The fuel delivery system must be heartily designed and fortified to prevent fuel leakage even under violent operating conditions. Leaked fuel on a marine vessel can, in extreme instances, result in fire which may require immediate human evacuation regardless of the vessel location or weather conditions.

Thus, meeting the fuel demands of a marine engine under these operating conditions and in consideration of these safety issues can be a challenge. A prior art technique to provide fuel to a marine engine is shown in applicant's own U.S. Pat. No. 6,257,208, the contents of which are hereby incorporated by reference. According to this technique, a high pressure fuel pump delivers a continual supply of fuel to the engine injector system in sufficient quantities to meet engine demands at so-called 'full throttle'. When the engine fuel demands are less than 'full throttle', a return line is employed to return unneeded fuel from the engine injector system to the vapor separator.

This re-circulation technique is currently state-of-the-art. It is believed to be necessary so that hot fuel in the engine injector system can be cooled to a less volatile temperature by re-mixing with liquid fuel in the vapor separator, and where any fuel vapors can be vented and bled out of the system.

One disadvantage of this technique resides in the requirement to design and fabricate the return line and associated fittings with extremely high quality and durable components to avert the possibility of fuel leakage over the foreseeable service interval of the fuel supply system. This increases both the cost of the fuel supply system and the risk of leakage, particularly where operating conditions are harsh and service intervals extend beyond manufacturer recommendations.

SUMMARY OF THE INVENTION AND ADVANTAGES

The subject invention overcomes the disadvantages of the prior art by eliminating the recirculation of unused fuel through the engine injector system. This, in turn, eliminates the added design and fabrication costs of a prior art style return line, and reduces the risk of fuel leakage.

According to the invention, a fuel supply system for a marine engine comprises a vapor separator for receiving liquid fuel from a fuel tank and collecting vapors given off from the fuel, a high pressure pump having a fuel inlet for withdrawing liquid fuel from the vapor separator and a fuel outlet, and a fuel delivery line for delivering fuel under pressure from the fuel outlet to an engine injector system. The invention is characterized by a bypass line which extends between the fuel delivery line and the vapor separator for returning excess fuel to the vapor separator prior to its reaching the engine injector system. In this manner, fuel in excess of the demands of the engine injector system is returned directly to the vapor separator thus eliminating the need to recirculate unneeded fuel through the engine injector system.

By eliminating the prior art return line and substituting in its place the novel bypass line, the number of possible fuel leak points can be reduced.

The present invention challenges the state-of-the-art presumption that hot fuel in the engine injector system must be cooled to a less volatile temperature by re-mixing with liquid fuel in the vapor separator, and where any fuel vapors can be vented and bled out of the system. The applicant has discovered that the hot fuel concerns are overstated in view of today's cleaner burning, less-volatile fuels required under current clean air legislation. Thus, hot fuel, which typically only becomes a concern during long periods of engine idle, is not problematic when a fuel supply system according to the subject invention is employed.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
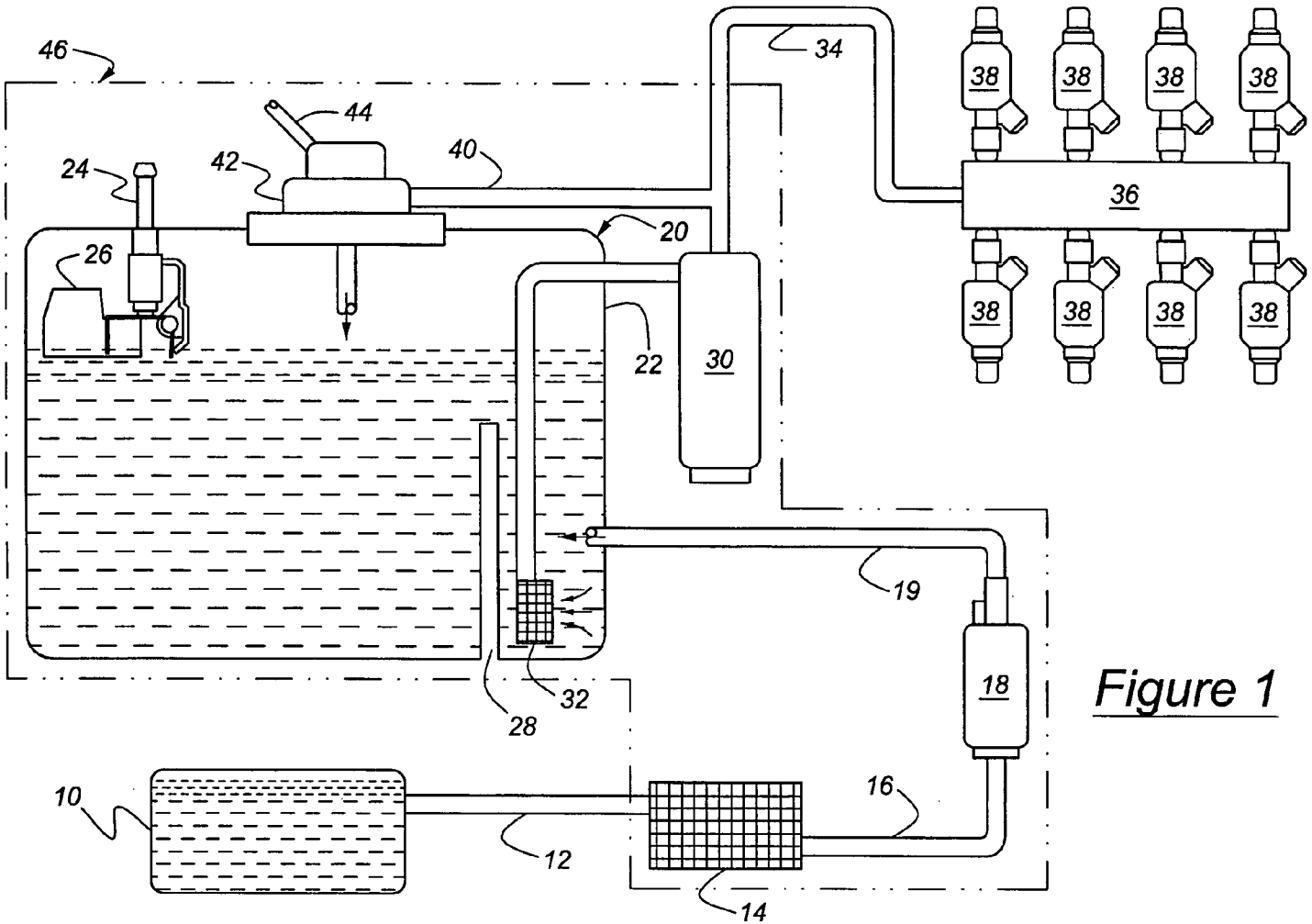
FIG. 1 is a schematic diagram of the subject invention.

Referring to the Figures, wherein like numerals indicate like or corresponding parts throughout the several views, a fuel supply system for a marine internal combustion engine in is illustrated schematically in FIG. 1.

The fuel supply system includes a fuel tank 10 from which tank-filter line 12 directs fuel to a water filter 14. In the water filter 14, any water present in the fuel is separated. Typically, the water filter 14 is replaced during regular servicing. A filter-pump line 16 routes fuel from the water filter 14 to a low-pressure type lift pump 18. The lift pump 18, in turn, urges fuel through a pump-separator line 19 into a vapor separator, generally indicated at 20.

The vapor separator 20 thus receives liquid fuel from the fuel tank 10 through this relatively direct distribution system. The primary purpose of the vapor separator 20 is to collect and discharge vapors given off from the fuel. The vapor separator 20 is defined by a housing 22 which is sealed to contain both the liquid fuel and vapors given off by the fuel. The pump-separator line 19 passes through the housing 22 to continually add more liquid fuel, and a vapor vent 24 allows vapors to bleed off. The vapor vent 24 is controlled by a float valve 26 which is responsive to the level of liquid fuel in the vapor separator 20. Whenever liquid fuel threatens to escape through the vapor vent 24, the float valve 26 automatically closes. In all non-threatening conditions, the vapor vent 24 remains open to exhaust fuel vapors.

The vapor separator 20 includes a baffle 28 inside the housing 22 adjacent the inlet point of the pump-separator line 19. The baffle 28 forms a partition within the housing and establishes a small reservoir area for maintaining a high level of fuel even during rapid turning and acceleration/deceleration conditions which might cause fuel in the remaining areas of the vapor separator 20 to slosh about.

A high pressure pump 30 has a fuel inlet 32 for withdrawing liquid fuel from the reservoir region of the vapor separator 20 behind the baffle 28. The high pressure pump 30 also has a fuel outlet communicating with a fuel delivery line 34 for delivering fuel under pressure to an engine injector system, generally indicated at 36. The engine injector system 36 can be of any type suited to vaporize fuel for a marine engine (not shown). In the typical case, the engine injector system 36 includes a plurality of injector pumps 38.

The high-pressure pump 30 is designed to run continuously whenever the engine is in operation. The pump 30 is also rated to provide maximum fuel delivery and pressure for engine 'full throttle' conditions. However, because an engine is not run at full throttle condition at all times, the pump 30 will attempt to deliver more fuel than is needed during other (non 'full throttle') conditions.

To alleviate excess pressure build-up in the fuel delivery line 34 and the associated fittings, as well as in the engine injector system 36, a bypass line 40 extends between the fuel delivery line 34 and the vapor separator 20. The bypass line 40 returns excess fuel to the vapor separator 20 prior to the fuel reaching the engine injector system 36 and thereby eliminates the need to recirculate unused fuel through the engine injector system 36.

The bypass line 40 includes a pressure regulator 42 which is closed whenever the pressure difference between the vapor separator 20 and the fuel delivery line 34 exceeds a predetermined value, and conversely is open whenever the pressure difference between the vapor separator 20 and the fuel delivery line 34 falls below a predetermined value. The pressure regulator 42 is provided with a vacuum fitting 44 for receiving a vacuum drawn from the engine (or by a vacuum pump) to increase its sensitivity and responsiveness.

Figure 2:
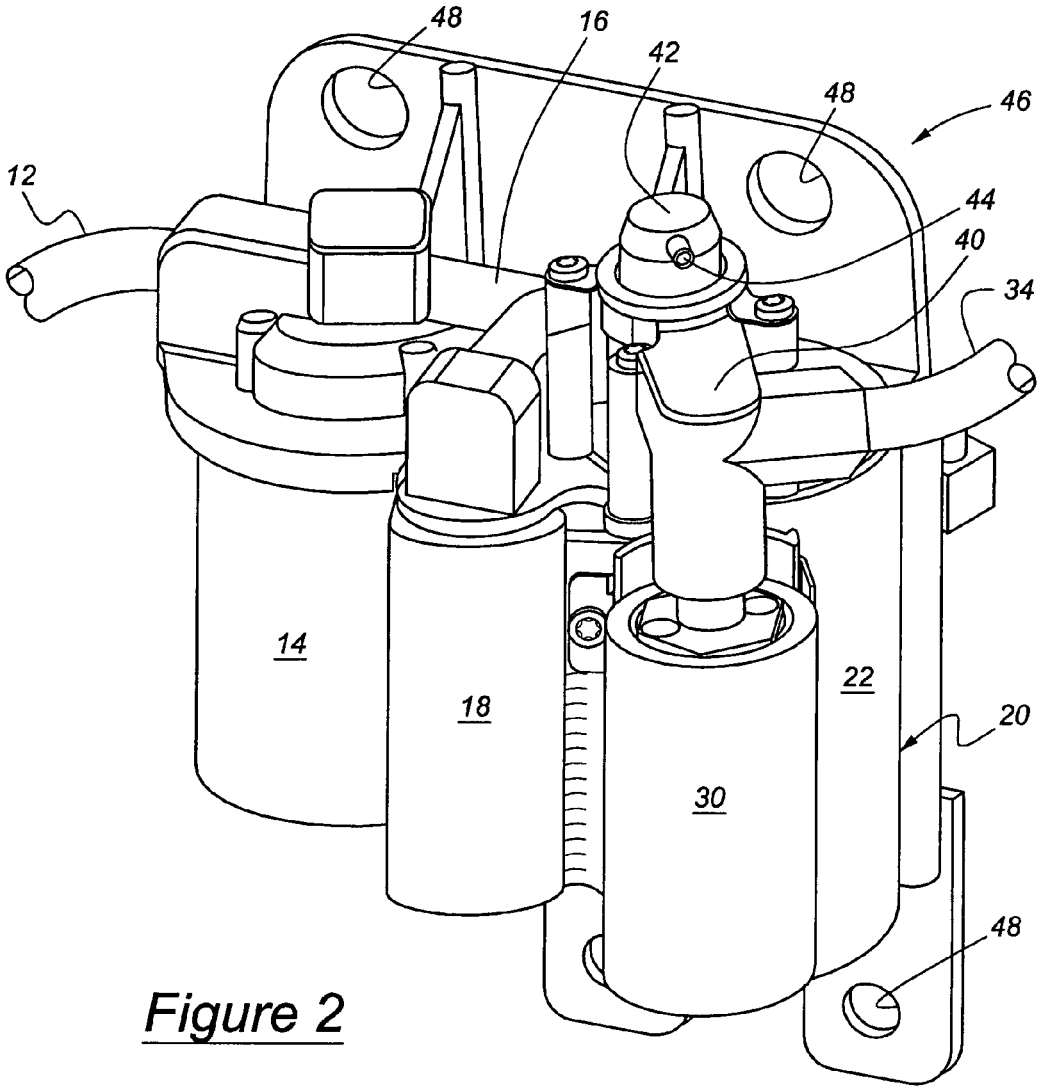
FIG. 2 is perspective view of an assembly according to the subject invention.

Referring now to FIG. 2, a perspective view of a fuel supply system according to the preferred embodiment of the invention is illustrated. In this view, it can be seen that the water filter 14, the lift pump 18, the high pressure pump 30, the bypass line 40, and the pressure regulator 42 are each integrally supported on the housing 22 as a unit together with vapor separator 20. This 'unit' is generally shown as 46 in FIG. 2, and represented by the phantom box in FIG. 1. Mounting holes 48 are provided on the rear face of the unit 46 for attaching in a convenient location within a marine vessel.

In an alternative embodiment not shown in the drawings, the vapor separator 20 and/or either of the pumps 18/30 may be cooled by circulating water through a jacket.

The particular advantages of the novel bypass line 40 are most evident in FIG. 2, where the short path from the fuel delivery line 34 adjoins adjacent the outlet from the high pressure pump 30, and returns fuel back into the vapor separator 20 without traversing large spaces in the marine vessel as was required by the prior art style return lines. Thus, by eliminating the prior art return line and substituting in its place the compact bypass line 40, the number of possible fuel leak points are reduced. And, the design and fabrication costs demanded of the prior art style return line can be substantially reduced, as well as the risk of fuel leakage. Preferably, the bypass line 40 and the pressure regulator 42 are formed integrally with the housing 22 to fully contain this system within the vapor separator 20.

In operation, fuel is supplied to the marine engine by first moving liquid fuel from the fuel tank 10 to the vapor separator 20 by use of the lift pump 18. Along the way, water is separated from the fuel with a water filter 14. In the vapor separator 20, vapors given off from the fuel are collected and vented, or bled, to atmosphere or other suitable collection system. The float valve 26 automatically interrupts the vapor bleeding in response to the level of liquid fuel in the vapor separator 20 reaching a predetermined height to prevent the escape of liquid fuel through the vapor vent 24.

The high pressure pump 30 withdraws liquid fuel from the vapor separator 20 and delivers it under pressure to the engine injector system 36 via a fuel delivery line 34. However, the fuel pressure between the high pressure pump 30 and the engine injector system 36 is monitored to determine whether the engine injector system is being presented with more fuel than is required for efficient engine operation. If more fuel than needed is being supplied by the high pressure pump 30, the extra, unneeded fuel is automatically returned to the vapor separator 20 through the bypass line 40 which adjoins the fuel delivery line 34 at a location upstream of the engine injector system 36. Thus, fuel in excess of engine demand is returned to the vapor separator 20 prior to its reaching the engine injector system 36.

This is accomplished by the pressure regulator 42, along the bypass line 40, which functions to prevent the return of fuel to the vapor separator 20 when the pressure in the vapor separator 20 is greater than the pressure of the fuel being delivered to the engine injector system 36. And conversely, the pressure regulator 42 allows the return of fuel to the vapor separator 20 when the pressure in the vapor separator 20 is greater than the pressure of the fuel being delivered to the engine injector system 36. To assist the pressure regulator 42, a vacuum is drawn upon it through a vacuum fitting 44.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein that which is prior art is antecedent to the characterized novelty and reference numerals are merely for convenience and are not to be in any way limiting, the invention may be practiced otherwise than as specifically described.

What is claimed is:

1. A fuel supply system for a marine engine comprising:

a vapor separator for receiving liquid fuel from a fuel tank and collecting vapors given off from the fuel, said vapor separator including a housing having an interior and an exterior;

a high pressure pump directly connected to said exterior of said vapor separator housing, said high pressure pump having a fuel inlet extending through said housing for withdrawing liquid fuel from said vapor separator and a fuel outlet;

a fuel delivery line communicating with said fuel outlet for delivering fuel under pressure to an engine injector system;

and characterized by a bypass line extending between said fuel delivery line and said vapor separator for returning excess fuel to said vapor separator whereby fuel in excess of the demands of the engine injector system is returned to said vapor separator prior to reaching the engine injector system and thereby eliminating the need to recirculate unneeded fuel through the engine injector system, said bypass line including a pressure regulator having a closed condition responsive to a predetermined pressure differential between said vapor separator and said fuel delivery line for interrupting fuel flow through said bypass line;

said high pressure pump, said bypass line and said regulator each being integrally supported on said housing exterior and directly connected together as a rigid, unitary structure.

2. A fuel supply system as set forth in claim 1 wherein said pressure regulator includes a vacuum assist.

3. A fuel supply system as set forth in claim 1 further including a lift pump for moving liquid fuel from the fuel tank to said vapor separator, said lift pump being integrally supported on said housing.

4. A fuel supply system as set forth in claim 3 further including a water separator filter disposed in fluid communication between the fuel tank and said lift pump, said water separator being integrally supported on said housing.

5. A fuel supply system as set forth in claim 1 further including a vapor vent disposed in said housing for bleeding off fuel vapors from said vapor separator, and a float valve response to the level of liquid fuel in said vapor separator for opening and closing said vapor vent.

6. A fuel system for a marine engine comprising:

a fuel tank for containing liquid fuel;

a vapor separator for receiving liquid fuel from said fuel tank and collecting vapors given off from the fuel, said vapor separator including a housing having an interior and an exterior, a high pressure pump directly connected to said exterior of said vapor separator housing, said high pressure pump having a fuel inlet extending through said housing for withdrawing liquid fuel from said vapor separator and a fuel outlet;

an engine injector system for receiving liquid fuel and delivering atomized fuel to a marine engine, said engine injector system having a variable demand for liquid fuel dependant upon the operating conditions of the marine engine;

a fuel delivery line for delivering liquid fuel under pressure from said fuel outlet of said high pressure pump to said engine injector system;

and characterized by a bypass line extending between said fuel delivery line and said vapor separator for returning excess fuel to said vapor separator so that fuel in excess of the demands of said engine injector system is returned to said vapor separator upstream of said engine injector system, said bypass line including a pressure regulator having a closed condition responsive to a predetermined pressure differential between said vapor separator and said fuel delivery line for interrupting fuel flow through said bypass line;

said high pressure pump, said bypass line and said regulator each being integrally supported on said housing exterior and directly connected together as a rigid, unitary structure.

7. A fuel supply system as set forth in claim 6 wherein said pressure regulator includes a vacuum assist.

8. A fuel supply system as set forth in claim 6 further including a lift pump for moving liquid fuel from said fuel tank to said vapor separator, said lift pump being integrally supported on said housing.

9. A fuel supply system as set forth in claim 8 further including a water separator filter disposed in fluid communication between said fuel tank and said lift pump, said water separator being integrally supported on said housing.

10. A fuel supply system as set forth in claim 6 further including a vapor vent disposed in said housing for bleeding off fuel vapors from said vapor separator, and a float valve response to the level of liquid fuel in said vapor separator for opening and closing said vapor vent.

* * * * *